United States Patent [19]

Schulze

[11] 4,369,693

[45] Jan. 25, 1983

[54] ELECTROHYDRAULIC SERVOMECHANISM

[75] Inventor: Eckehart Schulze, Weissach-Flacht, Fed. Rep. of Germany

[73] Assignee: Hartmann & Lämmle GmbH & Co. KG, Rutesheim, Fed. Rep. of Germany

[21] Appl. No.: 127,402

[22] Filed: Mar. 5, 1980

[30] Foreign Application Priority Data

Mar. 17, 1979 [DE] Fed. Rep. of Germany ..... 2910530

[51] Int. Cl.[3] ..... F15B 21/02

[52] U.S. Cl. ..... 91/35; 91/380; 91/382

[58] Field of Search ..... 91/37, 368, 380, 382, 91/35

[56] References Cited

U.S. PATENT DOCUMENTS 3,016,804 1/1962 Zanki ..... 91/37
3,192,783 7/1965 Cruzan ..... 92/33
3,752,036 8/1973 Hicks ..... 91/37
3,797,364 3/1974 Schulze ..... 91/382
3,989,223 11/1976 Burkhardt ..... 92/33

*Primary Examiner*—Abraham Hershkovitz
*Attorney, Agent, or Firm*—Michael J. Striker

[57] ABSTRACT

A servomechanism in which the mutual angular position of a threaded spindle relative to a tap is adjustable by a stepper motor wherein the unit of the threaded spindle and tap is connected directly or indirectly with a hydraulic working unit, the servomechanism includes a ball bearing arranged between the spindle and the tap. Consequently, by actuating the stepper motor to which the tap is connected via a coupling, the tap being rotated and moved in axial direction relative to the spindle, thereby actuating a switching mechanism connected to the working unit by which the spindle is caused to rotate. Accordingly, the relative axial movement between the spindle and the tap is compensated and the working unit is in a different position.

23 Claims, 3 Drawing Figures

ELECTROHYDRAULIC SERVOMECHANISM

BACKGROUND OF THE INVENTION

The invention relates to an electrohydraulic servomechanism for adjusting a desired value that is a mutual angular position of a threaded spindle relative to a tap by a stepper motor.

From German Pat. No. 2,062,134 a servomechanism is known in which the thread of a spindle is developed as a standard thread. The reproducibility of the adjustment is achieved by friction and by altering conditions of the oil film upon controlling the threaded spindle at 400 steps per rotation. With this principle, however, the reproducibility of the position of a working element is not very accurate.

SUMMARY OF THE INVENTION

Accordingly, the object of the invention is to overcome the difficulties of the prior art.

A more particular object of the present invention is to provide a servomechanism in which the reproducibility of the position of a working element is more accurate than achieved in the prior art so far.

Yet another object of the invention is to achieve a servomechanism which is simple in construction, reliable in operation and inexpensive in manufacture nevertheless.

In keeping with these objects, and with others which will become apparent hereafter, one feature of the invention resides, briefly stated, in a servomechanism which comprises a housing on whose one end a stepper motor casing is associated having a stepper motor therein connected to a coupling and on whose other end a rack is arranged, a sleeve-shaped tap extending rearwardly from the coupling into the housing and surrounding a major part of a threaded spindle which extends coaxially to the tap and is supporting a pinion on the one end remote to the stepper motor, the pinion meshing with the rack which is obliquely arranged to the spindle. The spindle is connected with a first ball bearing extending from the other end opposite to the pinion along a part of the spindle and is arranged between the spindle and the tap, the ball bearing including a cage on whose outside a first group of balls is guided and in engagement with grooves arranged on the surface of the tap facing the ball bearing for permitting a relative movement in axial direction between the tap and the spindle. A switching mechanism which is associated to the tap is connected to a working unit via a plurality of control valves, the working unit being connected to one end of the rack for rotating the spindle when the stepper motor is actuated.

In order to limit the relative movement between the threaded spindle and the tap, according to a further feature of the invention, the cage is provided with a stop at its final positions, the stop being developed as a spring acting on the face end in the region of the final position of the cage, thereby achieving an especially soft stopping.

Yet another feature of the invention is to construct the control valves as seat valves, thereby achieving an especially high reproducibility of a desired position. By accurately timing these seat valves, a response of the servomechanism to a movement of the tap relative to the threaded spindle is obtained within the $\mu$ range so that an adjustment of $1\mu$ and below is achieved upon a 1:1 gearing of the movement of the working unit with the movement of the threaded spindle and tap.

The accuracy of the adjustment can also be increased by using step-up gearing or step-down gearings for the connection of the working unit with the spindle on the tap depending on the purpose of use of the servomechanism and the required adjusting range of the working element. In order to achieve a transmission of movement without any play, it is advantageous to provide a helical gearing between pinion and rack thereby achieving that the individual impacts as occurring in a spur tooth are compensated.

Furthermore, it is desirable to flatten the rear side of the rack opposite to the gearing, and the rack can be guided in a guide roller which is opposite to the pinion and has a plain rolling surface in order to secure a uniform engagement of the helical gearing and to prevent a rotation of the rack. Yet another feature of the invention is to provide a spring for bracing the threaded spindle and the tap in axial direction wherein one end of the spring is abutting a support at the end of the spindle remote from the pinion and the other end of the spring is supported by an abutment within the tap remote from the spindle in axial direction.

Moreover, it is desirable for an accurate return movement of the working element to movably guide the rack in longitudinal guides on both sides of the pinion, and the one end of the rack which is connected to the working element can be protected against fouling and damaging by an extensible telescope spring while the other end of the rack is surrounded by a cover.

In the event that the adjustment by the stepper motor is too fast or the sliding of the working element is not possible, it is desirable to provide a plurality of emergency switches for the servomechanism which can be actuated by a switching element. Through the provision of such emergency switches, the motor can be disconnected thereby preventing a damaging of individual parts. When the switching element is actuating one of the emergency switches by means of a drag element, the drive is disconnected even during a slight reversing of the threaded spindle and tap. Consequently, the motor is disconnected in the direction in which a damaging would occur.

The drag element has two frictional surfaces which are braced with a guide plate via a spring, both frictional surfaces being connected with a bearing bolt penetrating the guide plate through a slit. Thus, the frictional surfaces can be arranged in a very simple manner by the surface of a disc supporting the bearing bolt and by the surface of a sleeve movable on the bolt through the spring.

The dragging motion is achieved by a recess in the disc opposite to the bearing bolt into which recess the switching element protrudes in such a manner that a play (clearance) therein is achieved. Consequently, the switching element can be retracted along a certain distance when reaching a final position without moving the drag member. Therefore, the emergency switch is still disconnecting the motor until the switching element has reached its normal mid position.

Through the provision of such a servomechanism, the reproducibility of the adjustment is increased approximately by a power of ten. The servomechanism according to the invention can be reproducibly controlled in a most accurate manner even when the threaded spindle is controlled by 4000 steps rotation. This surprising result is achieved by essentially reducing the friction between the tap and the threaded spindle by means of a ball bearing arranged in between. Therefore, an adjustment without delay and a very sensitive response of the control valves is obtained, thereby guaranteeing the readjusting when the stepper motor is operated with 4000 steps rotation. A reproducible adjustment of the working element is so accurate that a $\mu$ value of 1/1000 mm is achieved.

In this context, it is to be noted that essentially worse results have been achieved by using a ball rotating spindle. These tests have shown that no sufficiently reproducible control can be achieved due to the attrition of the circulating balls and the guide in only a few courses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
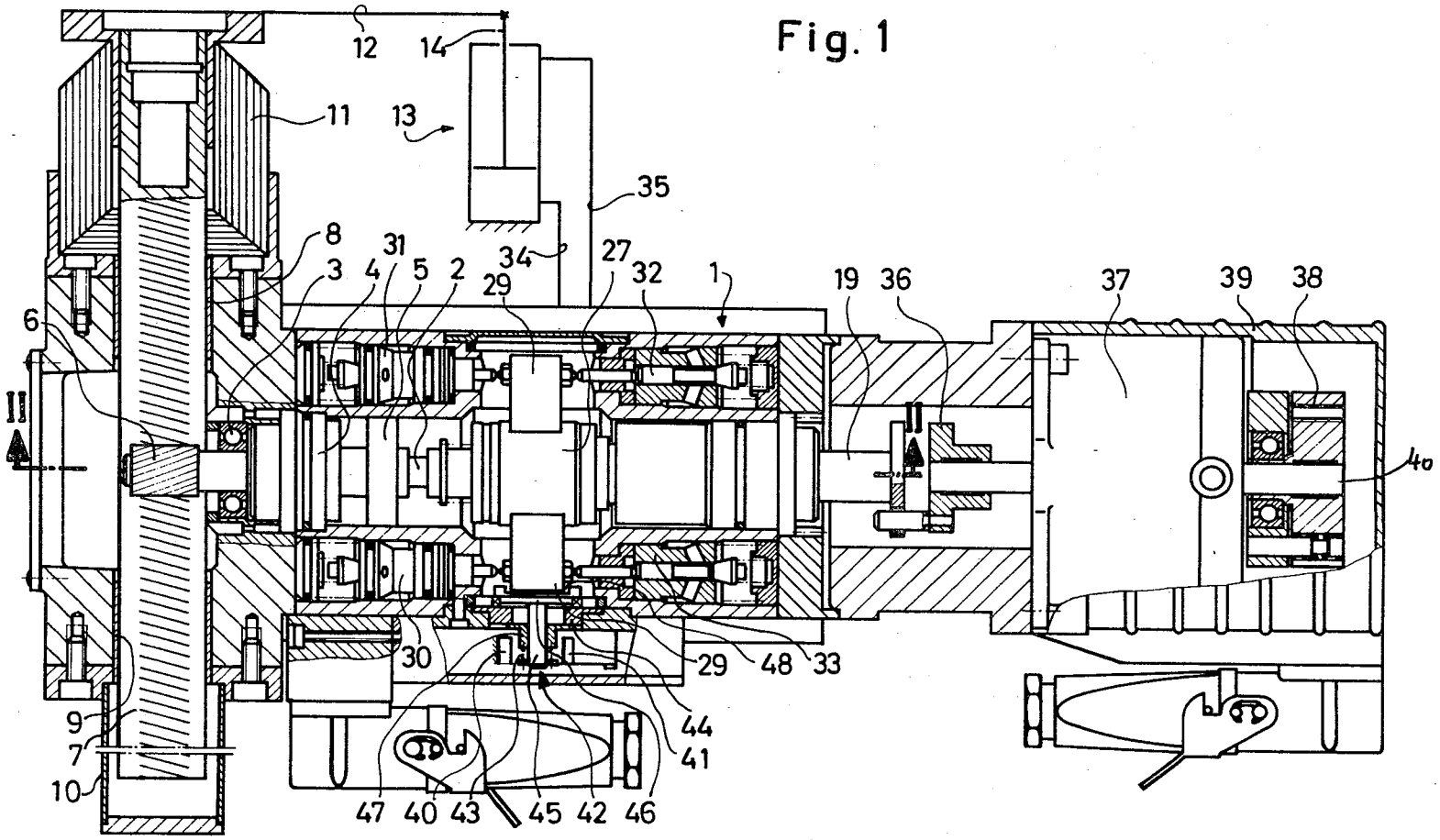
FIG. 1 shows a sectional view of an electrohydraulic servomechanism according to the invention wherein a working element and a stepper motor is diagrammatically depicted.
Figure 2:
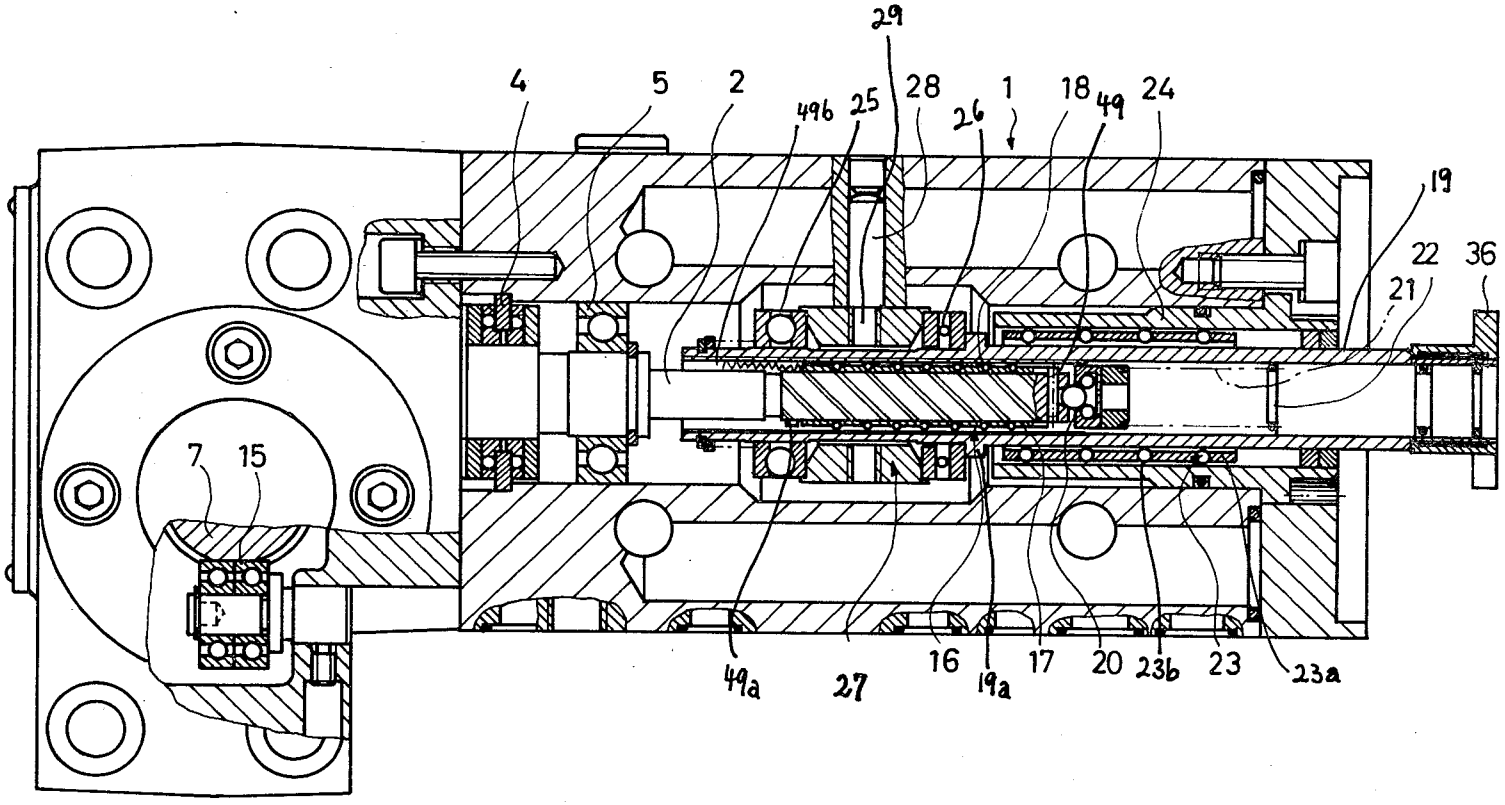
FIG. 2 shows a sectional view of the servomechanism shown in FIG. 1, along the line II—II in FIG. 1 wherein the stepper motor and the working element are omitted.

FIGS. 1 and 2 illustrate one embodiment of the servomechanism according to the present invention. The servomechanism has an elongated housing 1 on whose one ends, a stepper motor casing 39 is associated and on whose other end a rack 7 is provided obliquely to the housing 1. Within the housing 1 in axial direction thereto, there is arranged a threaded spindle 2, the one end thereof which is adjacent to the rack 7 is supported by three bearings 3, 4, 5 subsequently provided in axial direction of the spindle 2 wherein a part of the spindle is projecting beyond the bearing 3 while the other end thereof is supported in a bearing 20. Accordingly, the threaded spindle 2 is pivotable without performing an axial movement.

The free end of the spindle 2 which is projecting from the bearing 3 is coupled with a pinion 6. The pinion 6 meshes with the rack 7 by means of a helical gearing wherein the rack 7, which is obliquely arranged to the spindle 2, is movable in two longitudinal guides 8 and 9 on both sides of the pinion 6. One end of the rack 7 is encased by tubular cover 10 in order to provide protection against fouling and damaging. A telescopic spring 11 having a cross-sectional shape resembling an isosceles trapezoid, is provided, the outer end of which being associated to the housing 1 and the inner end of which being connected to the rack 7. Consequently, the rack 7 is always surrounded during a movement and thereby protected. As can be seen from FIG. 1, on the end of the rack 7 which is provided with the telescopic spring 11, there is fixed a connection 12 such as a rod which is associated to a piston 14 of a working unit 13 for example a hydraulic cylinder. The exact position of the piston 14 of the working unit 13 is to be time and speed controlled in an accurate manner according to given values which can be determined or are programmable electronically by working programs or in a different known manner.

Referring now to FIG. 2, there is shown a guide roll 15 associated to the rack 7 in opposing position to the pinion 6. The guide roll 15 has a plain rolling surface and is preventing rotational movement of the rack 7. In addition thereto, the rack 7 has a flattened construction on the side which is opposite to the helical gearing thereby guaranteeing that no rotation occurs.

Still referring to FIG. 2, there is shown a ball bearing 16 arranged coaxially on the threaded spindle 2 and extending rearwardly from the end of the spindle which is supported by the bearing 20 along a major part of the spindle 2. The ball bearing 16 includes a cage 17 for maintaining uniform separation between a plurality of balls 18. Surrounding the spindle 2 and the ball bearing 16 is a sleeve-shaped tap 19 having an inner surface on which grooves are provided for engaging with the balls 18 of the ball bearing 16 so that a relative movement between the threaded spindle 2 and the tap 19 can be obtained. In order to limit the axial movement of the tap 19, the cage 27 is provided with a stop at 49, **49*a* each final position. In a preferred embodiment, the stops are developed as a spring 49*b* thereby obtaining an especially soft stopping action. The sleeve-shaped tap 19 is projecting in axial direction from the housing 1 at the end which is opposite to the rack 7 and is connected with a stepper motor 37 via a coupling 36, as can be seen from FIG. 1, and is extending rearwardly therefrom, coaxially to the threaded spindle 2, to approximately the bearing 5. The stepper motor 37 having a shaft 40 is controlled in a known manner and presets the desired position, i.e. a certain angular position of the tap 19 relative to the threaded spindle 2. Fixed to the free shaft end of the stepper motor 37 is a vibration damper 38 for damping the vibration. In the vicinity of the coupling 36, an abutment 22 is arranged within the sleeve-shaped tap 19 which is supporting the one end of a spring 21 whose other end is abutting the bearing 20. Thus, a compensation for play between the threaded spindle 2 and the tap 19** is obtained due to the axial bracing with each other.

For achieving a rotating and axial movement of the tap 19, a second elongated ball bearing 23 is coaxially surrounding a part of the tap 19. The second ball bearing 23 includes a cage **23*a* for maintaining uniform separation between a second group of balls 23*b*. A cylindrical bushing 24 which is screwed to the housing 1 coaxially surrounds the second ball bearing 23 and has grooves on the innerside facing the ball bearing 23 in which the balls 23*b*** are correspondingly engaging.

As can be seen from FIG. 1, the sleeve-shaped tap 19 is further connected to a switching mechanism for actuating the working element 13. The switching mechanism has a sleeve 27 coaxially surrounding the tap 19 at the vicinity of the end remote from the projecting end thereof and is accurately guided in axial direction in bearings 25 and 26. Abutting the bearing 26 is a projection **19*a* which is integrally constructed with the tap 19. A pin 28 is in engagement with the sleeve 27 thereby preventing a rotational movement of the sleeve 27 while permitting a movement in axial direction. Screwed on the sleeve 27, there are arranged two block-shaped parts 29 serving as switching members which cooperate with four control valves 30, 31, 32 and 33 via adjustable stems. The control valves are connected in a known manner with a pressure oil supply and a return pipe which means are, however, not shown, and are further connected to the working unit 13 via conduits 34, 35. Advantageously, the control valves 30, 31, 32, 33** are developed as seat valves which are pressure balanced.

In the following the mode of operation is described. When the adjustment of the desired value is changed by the stepper motor 37, a rotation of the coupling 36 occurs, which rotation is transmitted to the sleeve-shaped tap 19. Since the threaded spindle 2 cannot execute any movement, the tap 19 is moving in axial direction simultaneously with the rotation due to the first ball bearing 16 between the spindle 2 and the tap 19. The switching element 29 which is in a fixed relation to the tap 19, thus also performs an axial movement by the projections 19*a* thereby actuating the control valves 30 to 33. Consequently, the working unit 13 is supplied with pressure thereby achieving a movement of the piston 14. Simultaneously, the rack 7 is moved because of its connection with the piston 14 via the connection 12 through which movement a rotation of the threaded spindle 2 is achieved through the pinion 6 which is meshing with the rack 7. The threaded spindle 2 rotates in a direction that the relative movement between the tap 19 and the spindle 2 is compensated and the control valves 30, 31, 32, 33 are shut again as soon as the piston 14 has reached the position which is preset by the stepper motor 37.

If the adjustment by the stepper motor 37 is too quick or a movement of the piston 14 is not possible, an inadmissible movement of the tap 19 and thus of the switching member 29 is obtained. Therefore, in order to prevent damaging of the parts, a disconnection of the drive is necessary. Accordingly, an emergency control is arranged within the housing 1 in the vicinity of the switching member 29. As can be seen from FIG. 1, the emergency control has two emergency switches 40, 41 which can be actuated by the switching member 29 via a drag element 42. The drag element 42 consists of two frictional surfaces braced with a guide plate 44 via a spring 43. The first frictional surface is formed by a disc 46 which supports perpendicularly projecting therefrom a bearing bolt 45 in its center. The second frictional surface is obtained by a sleeve 47 which is movable along the bearing bolt 45 through a spring 43. Opposite to the bearing bolt 45, the disc 46 has a recess 48 in which the switching member 29 is protruding with a clearance. Upon an axial movement of the sleeve-shaped tap 19, the swtiching member 29 is moving the drag element 42 in axial direction. In the event of an emergency, the motor 37 is disconnected via one of the two emergency switches 40 or 41 thereby preventing a further movement of the switching member 29. Consequently, the motor, i.e. a movement of the working unit 13 or a further operation of the stepper motor 37 occurs only in the opposite direction so that in any case the switching element is disconnected to the motor.

It is to be noted that the threaded spindle 2 can be connected directly or indirectly to a rotary motor via a transmission in order to control the threaded spindle 2 instead of connecting the working unit 13 to the threaded spindle 2 via the rack 7 as shown.

Figure 3:
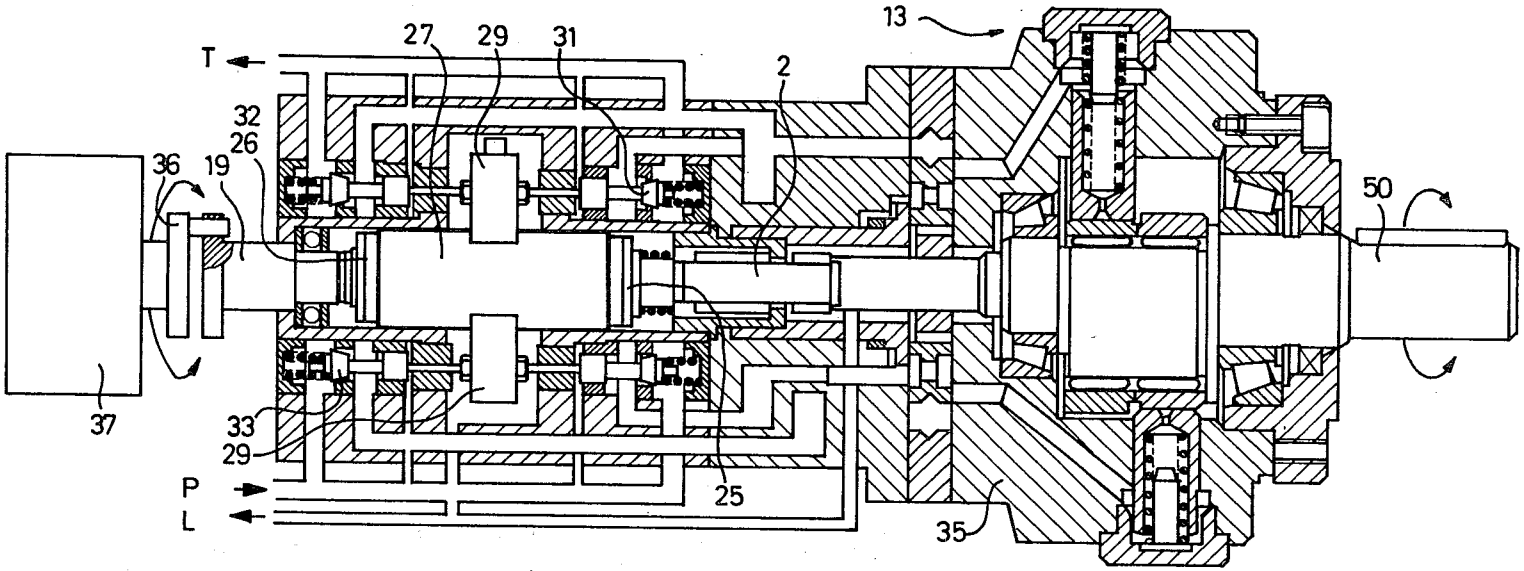
FIG. 3 is a sectional view of an electrohydraulic servomechanism developed as a rotating servomechanism.

FIG. 3 illustrates a further embodiment of the servomechanism the control essentially corresponding to the illustration in FIG. 1. Thus, the same numerals are used for corresponding parts. As can be seen from FIG. 3, the working unit 13 is developed as a hydromotor which is in connection with conduits 34, 35. The hydromotor has a power take-off shaft 50 which is directly connected with the threaded spindle 2 without any angular play. A pressure medium is supplied via a conduit P and can be returned to a container (not shown) via a conduit P. The quantities on waste oil can be returned to the tank of a pressure supplying unit (not shown) via a conduit L.

In the present embodiment, the rotation of the power take-off shaft 50 corresponds accurately to the rotational movement of the stepper motor 37 due to the direct connection of the power take-off shaft 50 with the threaded spindle 2 by interposing a transmission gearing either between the power take-off shaft 50 and the threaded spindle 2 or between the servomotor 37 and the tap 19 e.g. by using a toothed belt connected to belt pulleys of different diameters.

It will be understood that each of the elements described above, or two or more together, may also find a useful application in other types of electrohydraulic servomechanism different from the type described above.

While the invention has been illustrated and described as embodied in an electrohydraulic servomechanism, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A servomechanism, comprising a housing having one end and another end; a stepper motor casing on said one end and accomodating a stepper motor therein connected to a coupling; a rack on said other end; a sleeve-shaped tap extending rearwardly from the coupling into the housing and surrounding a major part of a threaded spindle extending coaxially to the tap and supporting a pinion on its one end remote from the stepper motor, the pinion meshing with the rack which is in an oblique position to the spindle; a fixed first ball bearing connected with the spindle and extending from the spindle end remote from the pinion along a part of the spindle and being arranged between the spindle and the tap, the ball bearing including a cage having an outside facing the tap and provided with a first group of balls separated by said cage and in engagement with respective grooves arranged on the surface of the tap facing the ball bearing for permitting a relative movement in axial direction between the tap and the spindle; and a switching mechanism associated with the tap and connected to a working unit via a plurality of control valves, the working unit being connected to one end of the rack for rotating the spindle.

2. A servomechanism as defined in claim 1, wherein the switching mechanism includes a sleeve surrounding the sleeve-shaped tap and movable in axial direction therewith upon a movement of the tap, and a block-shaped switching element connected to the sleeve and cooperating with the control valves.

3. A servomechanism as defined in claim 2, wherein the control valves are connected to the working unit for applying pressure thereto upon a movement of the tap.

4. A servomechanism as defined in claim 2, further comprising a pin protruding into the sleeve for preventing a rotational movement of the sleeve.

5. A servomechanism as defined in claim 4, wherein the pin is supported in the housing.

6. A servomechanism as defined in claim 1, wherein the pinion and the rack are in mesh along a helical gearing.

7. A servomechanism as defined in claim 6, wherein the rack has a flattened rear side opposite the helical gearing and is provided with a guide roll for preventing a rotational movement of the rack.

8. A servomechanism as defined in claim 7, wherein the guide roll has a plain rolling surface.

9. A servomechanism as defined in claim 7, wherein the rack is movable in longitudinal guides arranged on both sides of the pinion.

10. A servomechanism as defined in claim 1, wherein the one end of the rack connected to the working unit is protected by an extensible telescopic spring and the other end of the rack is surrounded by a cover.

11. A servomechanism as defined in claim 1, wherein the spindle and the tap are braced with each other in axial direction by at least one spring having one end abutting a bearing arranged within the tap at the end of the spindle remote to the pinion and another end supported by an abutment fixed within the tap remote from the end of the spindle.

12. A servomechanism as defined in claim 1, wherein the tap is guided in longitudinal direction in a second ball bearing for permitting an axial movement and a rotating movement.

13. A servomechanism as defined in claim 12, wherein the second ball bearing includes a cage for guiding a second group of balls in uniform separation, the balls of the second group rolling on a surface of the tap facing one side of the cage and on a counter surface facing the other side of the cage.

14. A servomechanism as defined in claim 13, wherein the surface of the tap and the counter surface are smooth cylindrical surfaces.

15. A servomechanism as defined in claim 14, wherein the counter surface is formed on a cylindrical sleeve which is mounted on the housing and rearwardly extends therefrom into the housing, said cylindrical sleeve surrounding a part of the tap and the second ball bearing disposed in between.

16. A servomechanism as defined in claim 1, wherein the cage of the first ball bearing is provided with a stop at each end position.

17. A servomechanism as defined in claim 16, wherein the stop is constructed as spring acting on the cage in its end position.

18. A servomechanism as defined in claim 1, wherein the first group of balls of the first ball bearing consists of carbide metal.

19. A servomechanism as defined in claim 1, further comprising an emergency control for preventing damage to the respective individual parts during an incorrect operation.

20. A servomechanism as defined in claim 19, wherein the emergency control includes a drag element associated with the switching element and movable therewith, and two emergency switches which are respectively actuated by the drag element in end positions thereof.

21. A servomechanism as defined in claim 19, wherein the drag element has two frictional surfaces braced with a guide plate via a spring, the frictional surfaces being connected through a bearing bolt protruding from the guide plate through a slit.

22. A servomechanism as defined in claim 20, wherein the one frictional surface is formed by a surface of a disc supporting the bearing bolt, and the other frictional surface is formed by a surface of a sleeve slidable along the bearing bolt by means of the spring.

23. A servomechanism as defined in claim 21, wherein the disc has in the surface opposite to the bearing bolt a recess into which the switching element protrudes with clearance.

* * * * *